US008502461B2

(12) United States Patent
Shiu et al.

(10) Patent No.: US 8,502,461 B2
(45) Date of Patent: Aug. 6, 2013

(54) DRIVING CIRCUIT AND CONTROL CIRCUIT

(75) Inventors: Shian-Sung Shiu, New Taipei (TW); Chung-Che Yu, New Taipei (TW); Li-Min Lee, New Taipei (TW)

(73) Assignee: Green Solution Technology Co., Ltd., New Taipei (TW)

( * ) Notice: Subject to any disclaimer, the term of this patent is extended or adjusted under 35 U.S.C. 154(b) by 289 days.

(21) Appl. No.: 13/115,129

(22) Filed: May 25, 2011

(65) Prior Publication Data

US 2011/0291591 A1 Dec. 1, 2011

(30) Foreign Application Priority Data

May 25, 2010 (TW) ..... 99116575 A
Mar. 22, 2011 (TW) ..... 100109787 A

(51) Int. Cl.
*H05B 37/02* (2006.01)
*G05F 1/00* (2006.01)

(52) U.S. Cl.
USPC ..... 315/192; 315/186; 315/307

(58) Field of Classification Search
USPC ..... 315/186, 192, 246, 209 R, 291, 307, 315/308, 312
See application file for complete search history.

(56) References Cited

U.S. PATENT DOCUMENTS 8,334,661 B2 * 12/2012 Lee et al. ..... 315/291
2009/0315468 A1 * 12/2009 Wu et al. ..... 315/186
2012/0176050 A1 * 7/2012 Li et al. ..... 315/192
2012/0313536 A1 * 12/2012 Kim et al. ..... 315/186
2013/0038233 A1 * 2/2013 Chu et al. ..... 315/224

* cited by examiner

*Primary Examiner* — Don Le
(74) *Attorney, Agent, or Firm* — Jianq Chyun IP Office

(57) ABSTRACT

A driving circuit, comprising a power supply, a transistor unit and a feedback control circuit, is disclosed. The power supply is adaptor to provide an electric power to drive a load. The transistor unit comprises at least one load coupling end to couple to the load for adjusting an amount of current flowing through the load. The feedback control circuit controls an amount of the electric power provided by the power supply according to a voltage level of the least one load coupling end. Wherein, the feedback control circuit comprises an error amplifying circuit and a feedback control switch. The error amplifying circuit generates an error amplified signal according to the voltage level of the least one load coupling end, and the feedback control switch is coupled to an output of the error amplifying circuit and is switched between a turn-on state and a turn-off state based on a dimming signal.

18 Claims, 3 Drawing Sheets

DRIVING CIRCUIT AND CONTROL CIRCUIT

CROSS-REFERENCE TO RELATED APPLICATION

This application claims the priority benefits of Taiwan patent application serial no. 099116575, filed on May 25, 2010, and Taiwan patent application serial no. 100109787, filed on Mar. 22, 2011. The entirety of each of the above-mentioned patent applications is hereby incorporated by reference herein and made a part of specification.

BACKGROUND OF THE INVENTION

1. Field of the Invention

The invention relates to a driving circuit and a control circuit.

2. Description of Related Art

At present, the electric energy accounts for 14% of the global energy each year, which is the maximum, and in the usage of the electric energy, the ratio of illumination is up to 22%. Accordingly, with a global trend of energy-saving and carbon reduction, the illumination plays a significant role in the current stage.

Currently, main illumination sources are generally incandescent bulbs and fluorescent lamps. Incandescent bulbs have the low cost, but they cannot satisfy the global trend of energy-saving and carbon reduction in the current stage due to the disadvantages of high power consumption, low illumination efficiency, and high thermal pollution. Fluorescent lamps are fabricated by glass and have plug openings in the two ends. Accordingly, fluorescent lamps can be connected with the power supply and fixed. Unlike incandescent bulbs, ballasts are required to be installed in fluorescent lamps and co-operates with starters to generate a high transient voltage which ionizes the gas to make fluorescent lamps lighting. The advantages of fluorescent lamps are the low cost and high illumination efficiency. However, fluorescent lamps also have some problems in the usage, such as flickering and pre-heating. The flickering frequency of fluorescent lamps is related to the driving voltage. The flickering of fluorescent lamp is not easy to be sensed by human eyes. However, the flickering may generate fan effect in some environments, which limits and affects the application in the environments. The pre-heating of fluorescent lamp may change the brightness in the initial lighting and after being used for a time period. Due to light emitting diodes (LEDs) having advantages of long lifespan, high illumination efficiency, stable brightness, LEDs become a mainstream product of next generation for lighting and illuminating.

The application of LEDs is fairly extensive, for example, indoor illumination, outdoor illumination, advertisement boards, back light module of electronic products, and so forth. In the foregoing application, the problems of the LEDs, such as high cost and heat dissipation are rapidly improved, and the overall permeability will rapidly increase in the future. With the LEDs gradually replacing current illumination sources, how to suitably drive the LEDs serving as illumination sources and provide suitable protection has now become one of the most important tasks. Accordingly, the LEDs can bring their capability into full play and the safety can also be enhanced in the usage.

SUMMARY OF THE INVENTION

In order to control LEDs to provide stable light-emitting corresponding to different driving method, in an exemplary embodiment of the invention, the LEDs are controlled to provide stable light-emitting in manners of current feedback and voltage feedback. Furthermore, in order to avoid the LED driving circuit encountering any problem in use, an exemplary embodiment of the invention also provides a protecting function to avoid the circuit being burnt when the problem which sufficiently affects the normal operation of the circuit occurs.

Accordingly, an embodiment of the invention provides a driving circuit comprising a power supply circuit, a transistor unit, and a feedback control circuit. The power supply circuit is adapted to provide a driving power to drive a load. The transistor unit has at least one load coupling terminal to be coupled to the load for adjusting a current flowing through the load. The feedback control circuit controls an amount of the driving power provided by the power supply circuit according to a voltage level of the least one load coupling terminal. Wherein, the feedback control circuit comprises an error amplified circuit and a feedback control switch, the error amplified circuit generates an error amplified signal according to the voltage level of the least one load coupling terminal, and the feedback control switch is coupled to an output of the error amplified circuit and is switched between a cut-off state and a turn-on state in response to a dimming signal.

An embodiment of the invention also provides a driving circuit, comprising a power supply circuit, a transistor unit, and a feedback control circuit. The power supply circuit is adapted to provide a driving power to drive a load. The transistor unit has at least one load coupling terminal to be coupled to the load for adjusting a current flowing through the load. The feedback control circuit controls an amount of the driving power provided by the power supply circuit according to a voltage level of the least one load coupling terminal. Wherein, the feedback control circuit comprises a feedback signal generating circuit and a feedback control switch, the feedback signal generating circuit is coupled to the transistor unit through the feedback control switch and generates a feedback processing signal according to a voltage level of the least one load coupling terminal, and the feedback control switch is coupled to the feedback signal generating circuit and is switched between a cut-off state and a turn-on state in response to a dimming signal.

An embodiment of the invention also still provides a control circuit comprising a capacitor, a charging unit, a discharging unit, a discharging unit, a feedback control unit, and a duty-cycle, adapted to control a power converting circuit for stabilizing an output of the power converting circuit. The charging unit has a first current source coupled to the capacitor for charging the capacitor. The discharging unit is coupled to the capacitor for discharging the capacitor. The feedback control unit controls the charging unit to charge the capacitor according to a feedback signal representing the output of the converting circuit. The duty-cycle adjusting unit generates a control signal, and adjusting a duty cycle of the control signal according to a voltage of the capacitor. Wherein, at least one of the charging unit and the discharging unit adjust a current provided there from in response to the feedback signal.

It is to be understood that both the foregoing general description and the following detailed description are exemplary, and are intended to provide further explanation of the invention as claimed. In order to make the features and the advantages of the invention comprehensible, exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
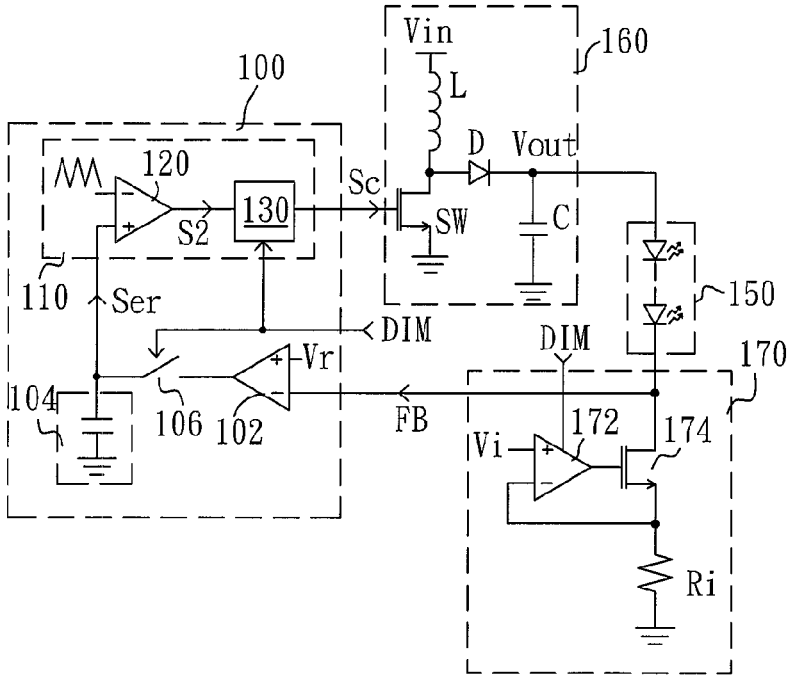
FIG. 1 is a schematic view of a driving circuit according to a first embodiment of the invention.

FIG. 1 is a schematic view of a driving circuit according to a first embodiment of the invention. Referring to FIG. 1, the driving circuit comprises a feedback control circuit 100, a transistor unit 170 and a power supply circuit 160, and is adapted to drive a load 150. In the present embodiment, the load 150 is an LED module having a plurality of LED strings. The power supply circuit 160 is coupled to an input power source Vin and according to a control signal Sc converts (e.g.: boost or buck) an electric power from the input power source Vin into an output voltage Vout to drive the LED module of the load 150 to light. In the present embodiment, the power supply circuit 160 is a Dc to DC boost converter, comprising a inductor L, a transistor SW, a rectifier diode D and an output capacitor C. An end of the inductor L is coupled to the input power source Vin, the other end thereof is coupled to an end of the transistor SW and another end of the transistor SW is grounded. An end of the output capacitor C is coupled to a connection point of the inductor L and the transistor SW through the rectifier diode D and the other end thereof is grounded. The transistor unit 170 is a current control circuit, coupled to the load 150 for adjusting a amount of current flowing through the load 150. The transistor unit 170 comprises a transistor 174 and a current control circuit 172. The transistor 174 has a current feedback terminal, a control terminal and a load coupling terminal. The current feedback terminal is coupled to a current detection resistor Ri, a load coupling terminal is coupled to the load 150, and the control terminal is coupled to an output end of current control circuit 172. The current control circuit 172 is an amplifier, in which a non-inverting end thereof receives a reference voltage V1 and an inverting end thereof is coupled to a current feedback terminal of the transistor 174. The current control circuit 172 controls the state of transistor 174 according to a voltage level of the current feedback terminal and the reference voltage Vi, i.e., adjusts the equivalent resistance of the transistor 174, to adjust the amount of current flowing through the transistor 174. The current control circuit 172 also receives a dimming signal DIM, adjusts the current flowing through the transistor 174 when the dimming signal DIM is in a "ON" state representing the LED module of the load 150 lighting, current control circuit 172 and cuts off transistor 174 when the dimming signal DIM is in "OFF" state representing the LED module of the load 150 stopping to light.

The feedback control circuit 100 is coupled to the load coupling terminal of the transistor 174 in the transistor unit 170 to receive a feedback signal FB representing a voltage across the transistor unit 170 so as to control an amount of the electrical power provided by the power supply circuit 160 in response to the voltage level of the load coupling terminal. The feedback control circuit 100 comprises a duty cycle control circuit 110, an error amplified circuit 102, a compensation circuit 104 and a feedback control switch 106. The error amplified circuit 102 generates an error amplified signal according to the feedback signal FB and a reference voltage signal Vr to the compensation circuit 104 to store and the compensation circuit 104 generates a feedback processing signal Ser. The feedback control switch 106 is coupled between an output of the error amplified circuit 102 and the compensation circuit 104 and is switched between a turn-on state and a cut-off according to the dimming signal DIM. When the dimming signal DIM represents "ON", the feedback control switch 106 is switched to be in the turn-on state so as to transmit the error amplified signal to the compensation circuit 104 to generate the feedback processing signal Ser. When the dimming signal DIM represents "OFF", the feedback control switch 106 is switched to be in cut-off state to stop transmitting the error amplified signal to the compensation circuit 104 and at this time the capacitor 116 keeps the level of the feedback processing signal Ser. The duty cycle control circuit 110 comprises a PWM (Pulse Width Modulated) circuit 120 and a driving unit 130. The PWM circuit 120 may be a comparator, in which an inverting terminal thereof receives a ramp signal and a non-inverting terminal thereof is coupled to the compensation circuit 104 to receive the feedback processing signal Ser, and accordingly generates a PWM signal S2 to the driving unit 130. The driving unit 130 receives the dimming signal DIM and the PWM signal S2. When the dimming signal DIM represents "ON", the driving unit 130 generates the control signal Sc according to the PWM signal S2 to switch the transistor SW of the power supply circuit 160 for adjusting the electric power provided by the power supply circuit 160. When the dimming signal DIM represents "OFF", the driving unit 130 stops the power supply circuit 160 to provide the electric power.

In accordance, when the dimming signal DIM represents "OFF", the transistor 174 of the transistor unit 170 is cut off to stop the current flowing through the load 150 so as to avoid continuously consume the energy stores in the output capacitor C during the period. In this moment, the power supply circuit 160 stops providing electric power and so the output voltage Vout is maintained at a voltage that is a voltage when the driving circuit stably operates. Besides, in this moment, the feedback control switch 106 of the feedback control circuit 100 is cut-off and so the level of the feedback processing signal Ser is also maintained at a level that is the level when the driving circuit stably operates. When the dimming signal DIM is turned to represent "ON", the load 150 could be immediately flowed through by a amount of current equal to that when the driving circuit stably operates, and the driving unit 130 also immediately provides the control signal Sc with a duty cycle equal to that when the driving circuit stably operates. Compared to the LED driving circuit in the arts, the driving circuit of the present invention has an advantage of fine dimming accuracy by immediately recovering the state of the driving circuit during the dimming process.

Figure 2:
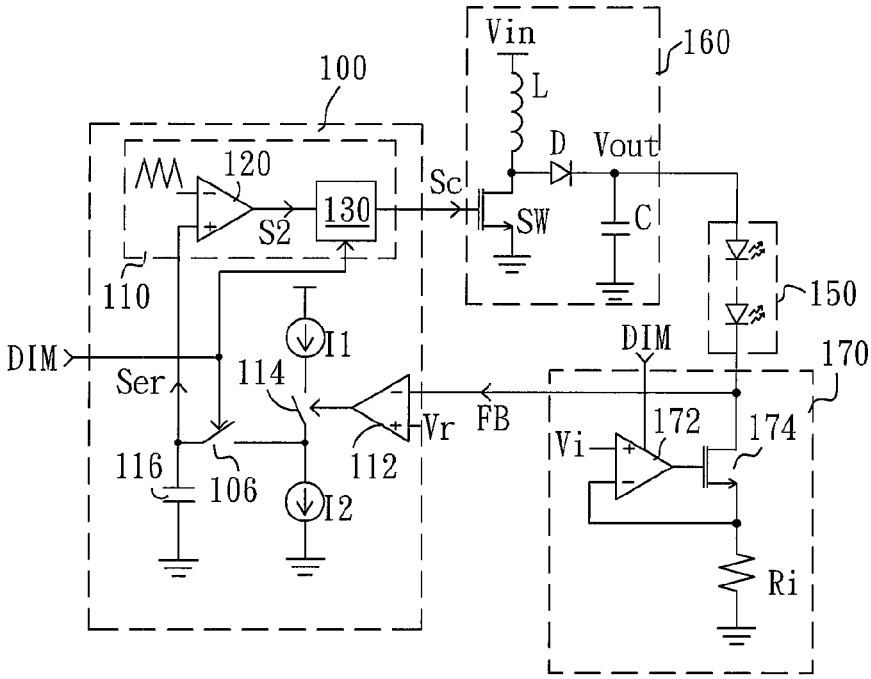
FIG. 2 is a schematic view of a driving circuit according to a second embodiment of the invention.

FIG. 2 is a schematic view of a driving circuit according to a second embodiment of the invention. Compared with the circuit shown in FIG. 1, the main difference is that the error amplified circuit 102, the compensation circuit 104 and the feedback control switch 106 is replaced by a feedback signal generating circuit. The explanation is as follows.

The feedback control circuit 100 comprises a duty cycle control circuit 110, a feedback control unit 112, a feedback control switch 106 and a feedback signal generating circuit, wherein the feedback signal generating circuit comprises a charging unit, a discharging unit and a capacitor 116. The charging unit has a first current source I1 and a charging switch 114, a first current source I1 is coupled to capacitor 116 through the charging switch 114 to provide a charging current to charge the capacitor 116. The discharging unit, having a second current source I2, is coupled to capacitor 116 to provide a discharging current to discharge the capacitor 116. In the present embodiment, feedback control unit 112 is a comparator has a non-inverting terminal receiving a reference voltage signal Vr and an inverting terminal receiving a feedback signal FB so as to switch the charging switch 114. The feedback control switch 106 connects the capacitor 116 to the first current source I1 and the second current source I2 and is switched between a turn-on state and a cut-off state according to a dimming signal DIM. When the dimming signal DIM represent "ON", the feedback control switch 106 is in the turn-on state and so the first current source I1 and the second current source I2 respectively charges and discharges the capacitor 116. Therefore, a voltage level of the capacitor 116 is adjusted according to the feedback signal FB to generate a feedback processing signal Ser. When the dimming signal DIM represents "OFF", the feedback control switch 106 is in the cut-off state to stop the first current source I1 and the second current source I2 respectively to charge and discharge the capacitor 116. Therefore, the capacitor 116 maintains a level the feedback processing signal Ser during the duration.

Hence, the driving circuit shown in the present embodiment also has a capable of maintaining the level of the feedback processing signal Ser when the dimming signal DIM represents "ON" and the driving unit 130 could immediately generates a control signal Sc with a duty cycle equal to that the driving circuit stably operates while the dimming signal DIM just turns to represent "ON". Consequently, the driving circuit driving circuit in the present embodiment also has the advantage of fine dimming accuracy.

The driving circuit according to the present invention is not only applied to the DC to DC boost converter mentioned above, but to another power supply circuit providing a DC output voltage, such as, fly-back converter, forward converter, and so on. The forward converter is taken as example in the following embodiment.

Figure 3:
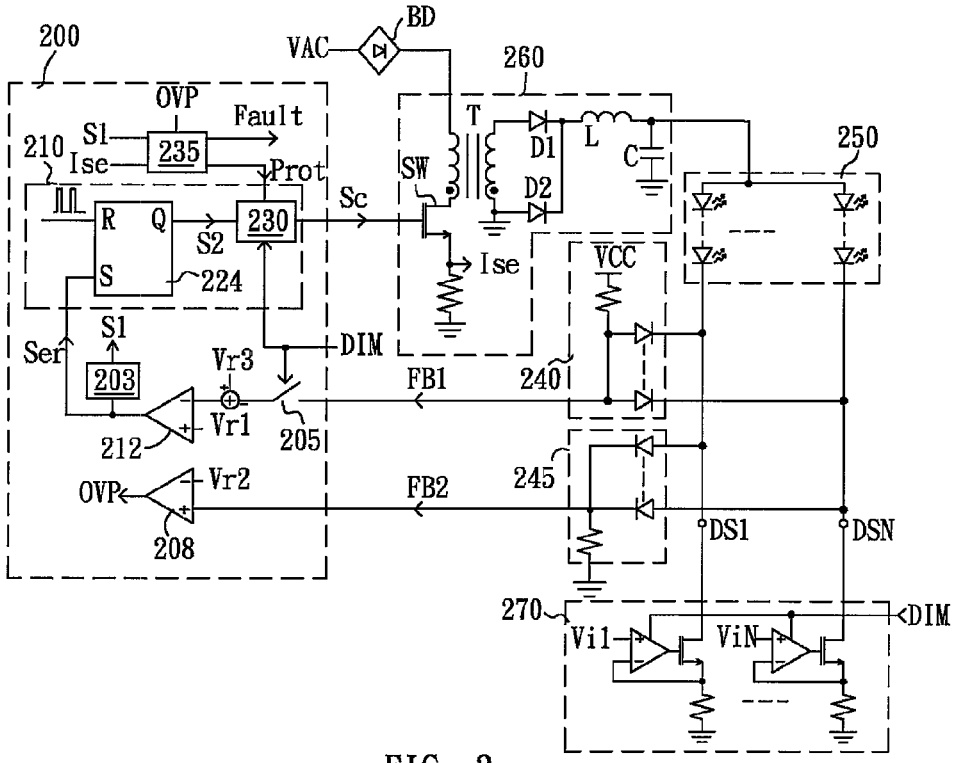
FIG. 3 is a schematic view of a driving circuit according to a third embodiment of the invention.

FIG. 3 is a schematic view of a driving circuit according to a third embodiment of the invention. The driving circuit, comprising a feedback control circuit 200, a transistor unit 270 and a power supply circuit 260, is adapted to drive an LED module 250. The LED module 250 has a plurality of LED strings connected in parallel. The power supply circuit 260 is coupled to an AC input power source VAC through a bridge rectifier BD and converts electric power from the AC input power source VAC to drive LED module 250 lighting according to the control signal Sc. In the present embodiment, the power supply circuit 260 is a forward converter, comprising a transformer T, a transistor SW, a rectifier diode D1, D2 and an output capacitor C. An end of a primary side of the transformer T is coupled to the AC input power source VAC the other end thereof is coupled to an end of the transistor SW, and another end of the transistor SW is grounded through a current detection resistor. An end of the output capacitor C is coupled to a secondary side of the transformer T through the rectifier diode D1, D2 and the other end is grounded.

In order to ensure that any LED in the LED module is flowed through with a predetermined amount of current, the transistor unit 270 has a plurality of load coupling terminals DS1~DSN, each respectively coupled to the plurality of LED strings in the LED module 250, so as to make the currents flowing through the plurality of LED strings be balanced with the predetermined amount. In the present embodiment, each of the plurality of load coupling terminals DS1~DSN is coupled to a current control circuit, and the current control circuit, as that shown in the above embodiment, comprises a transistor and a current control circuit. In actual application, the transistor unit 270 might use a current mirror circuit or another current source using transistors as a controller current source. Due to that each LED strings flowed through the predetermined current has different driving voltage there across, the voltage at the load coupling terminals DS1~DSN are different. For ensuring all the load coupling terminals DS1~DSN of the transistor unit 270 normally operating, i.e. controlling the current with the determined amount, the voltage level of the load coupling terminals DS1~DSN must keep above a first predetermined voltage level. For this reason, the present invention extra adds a first extreme voltage detection 240 that is coupled to a plurality of load coupling terminals DS1~DSN and generates first feedback signal FB1 according to the lowest voltage among the load coupling terminals DS1~DSN. The first extreme voltage detection 240 might comprises a plurality of diodes, wherein the cathodes are respectively coupled to the load coupling terminals DS1~DSN and the anodes are connected with each other and coupled to a driving power source via a resistor. Therefore, only a diode corresponding to the load coupling terminal with lowest voltage is forward biased, and other diodes are cut off due to the voltage across there is insufficient. Thus, the level of the first feedback signal FB1 is equal to that the lowest voltage among the load coupling terminals plus a forward bias voltage of diode. In addition, reference voltages Vi1~ViN applied to the current control circuits in the transistor unit 270 could be different to be applicable to different driving current requested by different applications. Of course, the reference voltages Vi1~ViN might be the same and so the currents flowing through all LEDs in the LED module is the same.

The feedback control circuit 200 comprises a duty cycle control circuit 210 and a feedback signal generating circuit. The feedback signal generating circuit has a feedback control unit 212, and the feedback control unit 212 might be a comparator having a non-inverting terminal receiving a first reference voltage signal Vr1 and an inverting terminal receiving a signal composed by the first feedback signal FB1 and a third reference voltage signal Vr3, e.g.: the level of the reference voltage signal Vr3 minus the level of the first feedback signal FB1 in this embodiment, wherein the level of the third reference voltage signal Vr3 is higher than that of the first reference voltage signal Vr1. When any one of the load coupling terminals DS1~DSN is lower than the first predetermined voltage level, the signal received by the inverting terminal of the feedback control unit 212 is lower than the first reference voltage signal Vr1 and so the feedback control unit 212 generates a feedback processing signal Ser. The duty cycle control circuit 210 comprises a SR latch 224 and a driving unit 230. A reset R terminal of the SR latch 224 receives a periodical pulse signal, a set S thereof receives the feedback processing signal Ser. Hence, when the feedback control unit 212 generates a feedback processing signal Ser, the SR latch 224 is triggered to generates a PWM signal S2 via an output terminal Q to the driving unit 230. The driving unit 230 receives a dimming signal DIM and a PWM signal S2. The transistor unit 270 is also receives the dimming signal DIM. When the dimming signal DIM represent "ON", the driving unit 230 generates a control signal Sc according to the PWM signal S2 to switch the transistor SW of the power supply circuit 260, so as to adjust the amount of electric power provided from the AC input power source VAC to the power supply circuit 260. The transistor unit 270 controls the power supply circuit 260 to provide electric power to drive the LED module 250 to stably light. When the dimming signal DIM represents "OFF", the driving unit 230 cuts off the transistor SW of the power supply circuit 260 to stop the AC input power source VAC providing electric power to the power supply circuit 260. Simultaneously, the transistor unit 270 also stops the power supply circuit 260 to drive the LED module 250 to light. For avoiding the feedback control circuit 200 against any erroneous judgments during this duration due to that the first feedback signal FB1 is too high, the feedback signal generating circuit might have a feedback control switch 205 coupled between the first extreme voltage detection 240 and the feedback control unit 212. The feedback control switch 205 is cut off when the dimming signal DIM represents "OFF". Hence, in this moment, the level of first reference voltage signal Vr1 is higher than that of the third reference voltage signal Vr3 minus the first feedback signal FB1, the feedback control unit 212 do not output the feedback processing signal Ser.

When any one of the load coupling terminals DS1~DSN is higher than a withstanding voltage of a corresponding transistor of the transistor unit 270, the transistor unit 270 will be damaged. For example, any one LED strings of the LED module 250 is open circuit, and it results in that the feedback control circuit 200 raises the output voltage of the power supply circuit 260 to try increasing the voltage level of the corresponding load coupling terminal to the predetermined voltage value and so another load coupling terminals will be over high. Some LEDs in one LED string in the LED module 250 may be short-circuit and it results in that the driving voltage of the LED string reduces. This also makes the voltage of the load coupling terminal of this LED string is also too high. In order to avoid the above problem, the present invention could extra add a second extreme voltage detection 245 coupled to a plurality of load coupling terminals DS1~DSN. The second extreme voltage detection 245 generates a second feedback signal FB2 according to the highest voltage among the load coupling terminals DS1~DSN. The second extreme voltage detection 245 comprises a plurality of diodes, in which the anodes thereof are respectively coupled to a plurality of load coupling terminals DS1~DSN and the cathodes thereof are connected with each other and are grounded via a resistor. The feedback control circuit 200 further comprises an over voltage comparator 208, in which a non-inverting terminal thereof receives the second feedback signal FB2 and an inverting terminal thereof receives a second reference voltage signal Vr2. When the level of the second feedback signal FB2 is higher than the second reference voltage signal Vr2, the over voltage comparator 208 outputs an over voltage protection signal OVP.

When the driving circuit operates normally, all the voltage levels of the plurality of load coupling terminals DS1~DSN can be maintained equal to or above the predetermined voltage. When any one voltage of the load coupling terminal is lower than the predetermined voltage and cannot be increased to achieve the predetermined voltage again, the driving circuit is abnormal. However, the voltage levels of the plurality of load coupling terminals DS1~DSN are temporarily lower than the predetermined voltage temp when the driving circuit is just started or during dimming process. In order to judge whether the driving circuit operating abnormally without erroneous judgments and, the feedback control circuit 200 might add a timing circuit 203 coupled to feedback control unit 212. When the first feedback signal FB1 is lower than first reference voltage signal Vr1 for a predetermined time period, i.e., the feedback control unit 212 outputs a high-level signal for the predetermined time period, the timing circuit 203 outputs an under-voltage protection signal S1. Of course, the timing circuit 203 might further receive an enabling signal or a dimming signal to determine a start-up timing of the timing circuit 203, wherein the enabling signal is a signal to enable the driving circuit. Due to that the capability of providing electric power by the power supply circuit depends on circuit designs, the appropriate predetermined time periods applied to different application are different. The feedback control circuit 200 according to the present invention can be a signal IC with a set pin, wherein the set pin is coupled with a external resistor or capacitor (not shown) to set the predetermined time period for different applications.

The feedback control circuit 200 further comprises a protection unit 235 coupled to timing circuit 203, the over voltage comparator 208 and the driving unit 230. When the feedback control circuit 200 receives any one of the over voltage protection signal OVP and the under-voltage protection signal S1, the feedback control circuit 200 outputs a protection signal Prot to stop the control driving unit 230 generating the control signal Sc for achieving a function of circuit protection. In addition, the protection unit 235 further receives a current detection signal Ise generated by a current detection resistor. If the output terminal of the power supply circuit 260 is open circuit, the current detection signal Ise will be low level for a predetermined time period. In this moment, the protection unit 235 also outputs the protection signal Prot to stop the driving unit 230 generating the control signal Sc. If the input terminal of the power supply circuit 260 is short circuit, the current detection signal Ise will be higher than an over current protection value. In this moment, the protection unit 235 can output a fault signal Fault to notify a post-stage circuit to stop providing electric power to the driving circuit so as to avoid component damaging due to short circuit.

Figure 4:
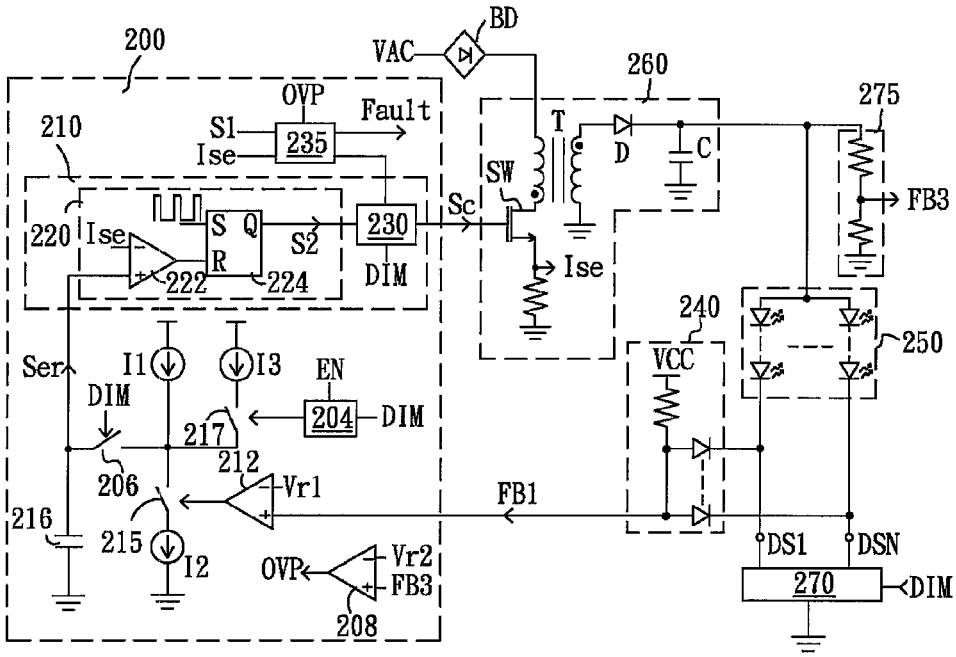
FIG. 4 is a schematic view of a driving circuit according to a fourth embodiment of the invention.

FIG. 4 is a schematic view of a driving circuit according to a fourth embodiment of the invention. Compared with the embodiment shown in FIG. 3, the main difference is that the power supply circuit 260 is fly-back converter and the type of feedback control is also different. The explanation is as follows.

The power supply circuit 260 is coupled to an AC input power source VAC through a bridge a bridge rectifier BD and converts electric power from the AC input power source VAC according to a control signal Sc to drive the LED module 250 lighting. In the present embodiment, the power supply circuit 260 comprises a transformer T, a transistor SW, a rectifier diode D and an output capacitor C. An end of a primary side of the transformer T is coupled to the AC input power source VAC and the other end thereof is coupled to an end of transistor SW, and another end of the transistor SW is grounded via a current detection resistor. An end of the output capacitor C is coupled to an end of a secondary side of transformer T through the rectifier diode D and the other end thereof is grounded.

The feedback control circuit 200 comprises a duty cycle control circuit 210 and a feedback signal generating circuit. The feedback signal generating circuit comprises a feedback control unit 212, a charging unit, a discharging unit and a capacitor 216, and is adapted to generate a feedback processing signal Ser. The charging unit has a first current source I1, a third current source I3 and a third switch 217. The first current source I1 is coupled to the capacitor 216 and provides a base charge current to charge the capacitor 216. The third current source I3 is coupled to the capacitor 216 through the third switch 217 to provide an extra charge current to charge the capacitor 216. The discharging unit has a second current source I2 and a second switch 215. The second current source I2 is coupled to capacitor 216 through the second 215 to provide a discharge current to discharge the capacitor 216. Wherein, the current provided by the first current source I1 is smaller than that provided by the second current source I2 as well as the third current source I3. The feedback control unit 212 might be a comparator, in which an inverting terminal thereof receives a first reference voltage signal Vr1, a non-inverting terminal thereof receives the first feedback signal FB1. Accordingly, the feedback control unit 212 switches the second switch 215. When a level of the first feedback signal FB1 is lower than that of the first reference voltage signal Vr1, the feedback control unit 212 outputs a low-level signal to cut off the second switch 215. In this moment, the first current source I1 charges the capacitor 216 to increase the voltage of the capacitor 216. When the level of the first feedback signal FB1 is higher than that of the first reference voltage signal Vr1, the feedback control unit 212 outputs a high-level signal to turn on the second switch 215. In this moment, the second current source I2 discharges the capacitor 216, while the first current source I1 charges the capacitor 216. The current provided by the first current source I1 is smaller than that provided by the second current source I2, and so the voltage of the capacitor 216 is lowered. The duty cycle control circuit 210 comprises a PWM (Pulse Width Modulated) circuit 220 and a driving unit 230. The PWM circuit 220 comprises a comparator 222 and a SR latch 224. A non-inverting terminal of the comparator 222 is coupled to the capacitor 216 to receive the feedback processing signal Ser, and an inverting terminal thereof receives the current detection signal Ise. A set terminal of the SR latch 224 receives a periodical pulse signal and a reset terminal R thereof is coupled to the output of the comparator 222. When the SR latch 224 receives the periodical pulse signal, an output terminal Q thereof generates a PWM signal S2 to the driving unit 230. The driving unit 230 receives the PWM signal S2 and a dimming signal DIM, and accordingly generates a control signal Sc to switch a transistor SW of the power supply circuit 260. When a current flowing through the primary side of the transformer T increases and so a level of the current detection signal Ise is higher than a voltage of the capacitor 216, the comparator 222 outputs a high-level signal to reset the SR latch 224, i.e., the output terminal Q of the SR latch outputs a low-level signal. In this moment, the driving unit 230 stops generating the control signal Sc and so the transistor SW of the power supply circuit 260 is cut off. Therefore, the energy stored in the transformer T is released to light LED module 250 via the secondary side of the power supply circuit 260.

In order to enhance a transient response of the feedback control circuit 200, the voltage of the capacitor 216 according to the present invention can be rapidly increased during the start-up process sand the dimming process. The feedback control circuit 200 switches the third switch 217 through a transient response enhancing circuit 204. The transient response enhancing circuit 204 receives an enabling signal EN and a dimming signal DIM. When receiving the enabling signal EN or when the dimming signal DIM represents "ON", the transient response enhancing circuit 204 outputs a high-level signal to turn the third switch 217 on so as to charge the capacitor 216 simultaneously by the third current source I3 and the first current source I1 for rapidly increasing the voltage of the capacitor 216. The transient response enhancing circuit 204 may be set with a predetermined time period to determine the timing of cutting off the third switch 217, i.e., the third switch 217 is turned on for a constant time period. Alternatively, the transient response enhancing circuit 204 also cut off the third switch 217 according to the first feedback signal FB1. In this embodiment, the transient response enhancing circuit 204 cuts off the third switch 217 when any one of the load coupling terminals DS1~DSN of the transistor unit 270 is higher than a predetermined level. A feedback control switch 206 is coupled the capacitor 216 to the charging unit and the discharging unit. When the dimming signal DIM represents "OFF", the feedback control switch 206 is cut off to keep the level of the feedback processing signal Ser generated by the capacitor 216.

Besides, in the present embodiment, the over voltage comparator 208 receives a feedback signal FB3, substituting for the second feedback signal FB2 shown in FIG. 3, via the non-inverting terminal. In which, the feedback signal FB3 is generated by a voltage detection circuit 275 detecting the output voltage of the power supply circuit 260. When the output voltage of the power supply circuit 260 is higher than a predetermined protection voltage, a level of the third feedback signal FB3 is higher than the second reference voltage signal Vr2 and so the over voltage comparator 208 outputs the over voltage protection signal OVP. The protection unit 235 outputs a protection signal Prot when receiving the over voltage protection signal OVP to stop the driving unit 230 generating the control signal Sc.

Figure 5:
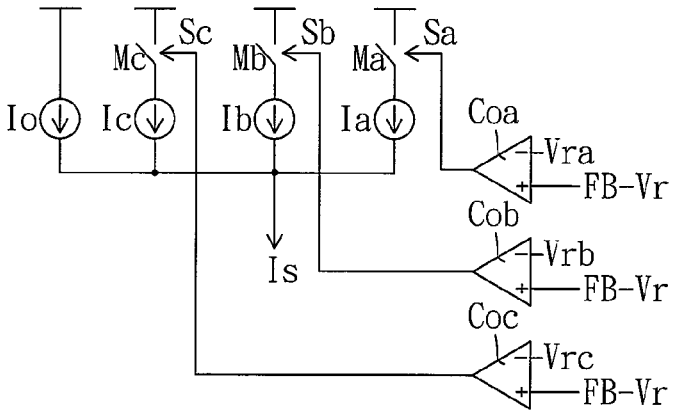
FIG. 5 is a schematic view of a controlled current source circuit according to a preferred embodiment of the invention.

In the present invention, the current source, i.e., the first current source I1, the second current source I2, and the third current source I3 mentioned above, could be a constant current source, and alternatively a controlled current source that provides a current according to the feedback signal to further enhance the transient response of the control circuit. For example, the current provided by the controller current source is adjusted according to a difference between the feedback signal FB and the reference voltage by means of line type, stair-step type or other type, so as to increase the current when the difference increasing. FIG. 5 is a schematic view of a controlled current source circuit according to a preferred embodiment of the invention. The controlled current source, comprising current sources Io, Ia, Ib, Ic and current switches Ma, Mb, Mc, and comparators Coa, Cob, Coc, is adapted to provide a current Is. The comparator Coa compares a comparison reference signal Vra and a difference absolute value FB-Vr of the feedback signal and comparison reference signal. When the difference absolute value FB-Vr is higher than the comparison reference signal Vra, the comparator Coa outputs a control signal Sa to turn the current switch Ma on to add a current provided by the current source Ia into the current Is. The comparator Cob compares a comparison reference signal Vrb and a difference absolute value FB-Vr of the feedback signal and comparison reference signal. When the difference absolute value FB-Vr is higher than the comparison reference signal Vrb, the comparator Cob outputs a control signal Sb to turn the current switch Mb on to add a current provided by the current source Ib into the current Is. The comparator Coc compares a comparison reference signal Vrc and a difference absolute value FB-Vr of the feedback signal and comparison reference signal. When the difference absolute value FB-Vr is higher than the comparison reference signal Vrc, the comparator Coc outputs a control signal Sc to turn the current switch Mc on to add a current provided by the current source Ia into the current Is. In which, a level of the comparison reference signal Vrb is higher than that of the comparison reference signal Vra, and a level of the comparison reference signal Vrc is higher than that of the comparison reference signal Vrb. Hence, when the difference absolute value FB-Vr is lower than the comparison reference signal Vra, the current Is is the current provided by the current source Io. when the difference absolute value FB-Vr is higher than the comparison reference signal Vra but lower than the comparison reference signal Vrb, the current Is is the sum of currents provided by the current source Io and the current source Ia. The rest may be deduced by analogy, and so the controlled current source could provides a larger current when the level difference between the reference signal and the feedback signal increasing to enhance the transient response of the control circuit.

As the above description, the invention completely complies with the patentability requirements: novelty, non-obviousness, and utility. It will be apparent to those skilled in the art that various modifications and variations can be made to the structure of the invention without departing from the scope or spirit of the invention. In view of the foregoing descriptions, it is intended that the invention covers modifications and variations of this invention if they fall within the scope of the following claims and their equivalents.

What is claimed is:

1. A driving circuit, comprising:

a power supply circuit, adapted to provide a driving power to drive a load;

a transistor unit, having at least one load coupling terminal to be coupled to the load for adjusting a current flowing through the load; and a feedback control circuit, controlling an amount of the driving power provided by the power supply circuit according to a voltage level of the least one load coupling terminal;

wherein, the feedback control circuit comprises an error amplified circuit and a feedback control switch, the error amplified circuit generates an error amplified signal according to the voltage level of the least one load coupling terminal, and the feedback control switch is coupled to an output of the error amplified circuit and is switched between a cut-off state and a turn-on state in response to a dimming signal.

2. The driving circuit as claimed in claim 1, wherein the transistor unit has a plurality of transistors and a plurality of current control circuits, each of the transistors has a control terminal, a current feedback terminal and the load coupling terminal, and each of the current control circuits controls a state of a corresponding transistor so as to adjust the current flowing through the corresponding transistor according to the voltage level of the current feedback terminal of the corresponding transistor.

3. The driving circuit as claimed in claim 2, wherein feedback control circuit further comprises a compensation circuit for storing the error amplified signal, and the feedback control switch transmits the error amplified signal to the compensation circuit when being in the turn-on state and stops transmitting the error amplified signal to the compensation circuit when being in the cut-off state.

4. The driving circuit as claimed in claim 2, wherein the feedback control circuit further comprises a duty cycle control circuit adapted to control the power supply circuit to convert an electric power from an input power source into the driving power according to the error amplified signal and the duty cycle control circuit stops the power supply circuit to convert when the feedback control switch is in the cut-off state.

5. The driving circuit as claimed in claim 2, wherein the plurality of current control circuits cut off the plurality of transistors further according to a dimming signal.

6. The driving circuit as claimed in claim 2, wherein when feedback control switch is in turn-on state and any one of the load coupling terminals is lower than a first predetermined voltage level or higher than a second predetermined voltage level, the feedback control circuit stops the power supply circuit to convert an electric power from an input power source into the driving power, wherein the second predetermined voltage level is higher than the first predetermined voltage level.

7. The driving circuit as claimed in claim 2, wherein the power supply circuit comprises:

a power converting circuit coupled to an input power source and converting an electric power from the input power source into the driving power according to a control signal to drive the load s; and a control circuit, generating the control signal according to a feedback signal representing a state of the load, comprising:

a capacitor;

a charging unit coupled to the capacitor for charging the capacitor;

a discharging unit coupled to the capacitor for discharging the capacitor;

a feedback control unit controlling the charging unit to charge the capacitor according to the feedback signal; and a duty-cycle adjusting unit generating the control signal and adjusting a duty cycle of the control signal according to a voltage of the capacitor.

8. The driving circuit as claimed in claim 7, wherein the charging unit adjusts a current provided there-from in response to the feedback signal.

9. The driving circuit as claimed in claim 7, wherein the discharging unit adjusts a current provided there-from in response to the feedback signal.

10. A driving circuit, comprising:

a power supply circuit, adapted to provide a driving power to drive a load;

a transistor unit, having at least one load coupling terminal to be coupled to the load for adjusting a current flowing through the load; and a feedback control circuit, controlling an amount of the driving power provided by the power supply circuit according to a voltage level of the least one load coupling terminal;

wherein, the feedback control circuit comprises a feedback signal generating circuit and a feedback control switch, the feedback signal generating circuit is coupled to the transistor unit through the feedback control switch and generates a feedback processing signal according to a voltage level of the least one load coupling terminal, and the feedback control switch is coupled to the feedback signal generating circuit and is switched between a cut-off state and a turn-on state in response to a dimming signal.

11. The driving circuit as claimed in claim 10, wherein the transistor unit has a plurality of transistors and a plurality of current control circuits, each of the transistors has a control terminal, a current feedback terminal and the load coupling terminal, and each of the current control circuits controls a state of a corresponding transistor so as to adjust the current flowing through the corresponding transistor according to the voltage level of the current feedback terminal of the corresponding transistor.

12. The driving circuit as claimed in claim 11, wherein the feedback control circuit further comprises a duty cycle control circuit adapted to control the power supply circuit to convert an electric power from an input power source into the driving power according to the feedback processing signal and the duty cycle control circuit stops the power supply circuit to convert when the feedback control switch is in the cut-off state.

13. The driving circuit as claimed in claim 11, wherein the plurality of current control circuits cut off the plurality of transistors further according to a dimming signal.

14. The driving circuit as claimed in claim 11, wherein when feedback control switch is in turn-on state and any one of the load coupling terminals is lower than a first predetermined voltage level or higher than a second predetermined voltage level, the feedback control circuit stops the power supply circuit to convert an electric power from an input power source into the driving power, wherein the second predetermined voltage level is higher than the first predetermined voltage level.

15. A control circuit, adapted to control a power converting circuit for stabilizing an output of the power converting circuit, the control circuit comprising:

a capacitor;

a charging unit having a first current source coupled to the capacitor for charging the capacitor;

a discharging unit coupled to the capacitor for discharging the capacitor;

a feedback control unit controlling the charging unit to charge the capacitor according to a feedback signal representing the output of the converting circuit; and a duty-cycle adjusting unit generating a control signal, and adjusting a duty cycle of the control signal according to a voltage of the capacitor:

wherein, at least one of the charging unit and the discharging unit adjust a current provided there from in response to the feedback signal.

16. The control circuit as claimed in claim 15, wherein the charging unit has a first switch coupled between the first current source and the capacitor, the feedback control unit has a comparator, and the comparator controls the first switch to be conducted or cut off according to the feedback signal and a reference voltage signal.

17. The control circuit as claimed in claim 15, further comprising a protecting unit, generating a protecting signal to have the duty-cycle adjusting unit to stop outputting the control signal when a level of the feedback signal is lower than a first protecting value, or the level of the feedback signal is lower than the first protecting value for a predetermined time period.

18. The control circuit as claimed in claim 15, further comprising a protecting unit, generating a protecting signal to have the duty-cycle adjusting unit to stop outputting the control signal when a level of the feedback signal is higher than a second protecting value, or an output voltage of the power converting circuit is higher than a third protecting value.

* * * * *